US005141625A

United States Patent [19]

Lomas

[11] Patent Number: 5,141,625

[45] Date of Patent: Aug. 25, 1992

[54] SECOND STAGE STRIPPING AND LIFT GAS SUPPLY

[75] Inventor: David A. Lomas, Arlington Heights, Ill.

[73] Assignee: UOP, Des Plaines, Ill.

[21] Appl. No.: 611,560

[22] Filed: Nov. 13, 1990

Related U.S. Application Data

[63] Continuation-in-part of Ser. No. 457,463, Dec. 27, 1989, Pat. No. 4,988,430.

[51] Int. Cl.[5] ..... C10G 11/20

[52] U.S. Cl. ..... 208/113; 208/120; 208/150; 208/160; 208/161; 208/164

[58] Field of Search ..... 208/161, 100, 113, 160, 208/164, 120, 150

[56] References Cited

U.S. PATENT DOCUMENTS

| | | | |
|---|---|---|---|
| 4,234,411 | 11/1980 | Thompson | 208/74 |
| 4,464,250 | 8/1984 | Myers et al. | 208/120 |
| 4,572,780 | 2/1986 | Owen et al. | 208/161 |
| 4,605,491 | 8/1986 | Haddad et al. | 208/161 |
| 4,624,771 | 11/1986 | Lane et al. | 208/74 |
| 4,624,772 | 11/1986 | Krambeck et al. | 208/161 |
| 4,629,552 | 12/1986 | Haddad | 208/161 |
| 4,689,206 | 8/1987 | Owen et al. | 208/161 |
| 4,737,364 | 4/1988 | Haddad et al. | 208/161 |
| 4,789,458 | 12/1988 | Haddad et al. | 208/151 |
| 4,853,003 | 8/1989 | Dewitz | 208/161 |
| 4,904,281 | 2/1990 | Raterman | 208/161 |
| 4,921,596 | 5/1990 | Chou et al. | 208/161 |
| 4,988,430 | 1/1981 | Sechrist et al. | 208/161 |
| 4,994,168 | 2/1984 | Harandi et al. | 208/100 |

*Primary Examiner*—Helane E. Myers
*Attorney, Agent, or Firm*—Thomas K. McBride; John G. Tolomei

[57] ABSTRACT

The use of lift gas for FCC risers is improved by the direct use of stripping vapors from a second stage of catalyst stripping as a lift gas. Reactor vapors recovered primarily from the stripping section of an FCC reactor/regenerator section provide an excellent source for lift gas material. These reactor vapors contain high concentrations of light paraffinic materials often with an equal weight percent amount of steam. The recovery of the stripping vapors independent from the product stream allows such gaseous mixtures to be readily used as lift gas. The lift gas material is obtained from a stripping section located subadjacent to a regenerator section so that it will have adequate pressure for use as a lift gas stream. The relatively high pressure of the lift gas stream eliminates processing requirements that would otherwise be necessary for the removal of particulate material and the compression of the gas to the pressure conditions at the bottom of the riser. This invention is readily practiced in the most recent FCC reactor designs that separate the majority of product vapors from the catalyst in a first or preliminary stripping arrangement. This invention is particularly suited for use in conjunction with hot catalyst stripping. Hot catalyst stripping produces a high concentration of very low molecular weight gas components in the effluent from the hot stripping zone which are highly suitable for use as lift gas material.

14 Claims, 2 Drawing Sheets

SECOND STAGE STRIPPING AND LIFT GAS SUPPLY

CROSS-REFERENCE TO RELATED APPLICATION

This application is a continuation in part of U.S. Ser. No. 457,463, filed Dec. 27, 1989, now issued as U.S. Pat. No. 4,988,430.

FIELD OF THE INVENTION

This invention relates generally to processes for the fluidized catalytic cracking (FCC) of heavy hydrocarbon streams such as vacuum gas oil and reduced crudes. This invention relates more specifically to a method for reacting hydrocarbons in an FCC reactor and separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium. The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction temperatures change. That is, if it is desired to increase the conversion rate an increase in the rate of flow of circulating fluid catalyst from the regenerator to the reactor is effected. Since the catalyst temperature in the regeneration zone is usually held at a relatively constant temperature, significantly higher than the reaction zone temperature, any increase in catalyst flux from the relatively hot regeneration zone to the reaction zone affects an increase in the reaction zone temperature.

Reductions in the availability of relatively light FCC feeds has made it necessary at times to process feeds in FCC units that have higher molecular weights and an increased tendency to lay down coke deposits on the catalyst in the reaction zone and carry over light combustible products from the reaction zone to the regeneration zone. Increased production of coke and the combustion of relatively low molecular weight cracking products generates more heat in the regenerator as the coke is burned from the surface of the catalyst. The resulting higher catalyst temperatures can adversely influence the catalyst to oil ratio in the reactor riser and result in catalyst deactivation. A number of regeneration techniques are practiced to minimize or remove the heat released by the combustion of large amounts of coke in the regenerator. These methods include the direct removal of heat by the use of catalyst that use a cooling fluid to cool the catalyst by indirect heat exchange, and operation of the regeneration of the regeneration zone to limit the combustion of CO to $CO_2$. However these methods have typically required multiple regeneration stages or additional contacting vessels and neither of these methods eliminates the loss of relatively low molecular weight products in the regeneration zone.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

As the development of FCC units has advanced, temperatures within the reaction zone were gradually raised. It is now commonplace to employ temperatures of about 525° C.(975° F.). At higher temperatures, there is generally a loss of gasoline components as these materials crack to lighter components by both catalytic and strictly thermal mechanisms. At 525° C., it is typical to lose 1% on the potential gasoline yield due to gasoline components thermally cracking into lighter hydrocarbon gases. As temperatures increase, to say 1025° F.(550° C.), most feedstocks lose up to 6% or more of the gasoline yield due to thermal cracking of gasoline components.

One improvement to FCC units, that has reduced the product loss by thermal cracking, is the use of riser cracking. In riser cracking, regenerated catalyst and starting materials enter a pipe reactor and are transported upward by the expansion of the gases that result from the vaporization of the hydrocarbons, and other fluidizing mediums, if present, upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

The benefits of using lift gas to pre-accelerate and condition regenerated catalyst in a riser type conversion zone are well known. Lift gas typically has a low concentration of heavy hydrocarbons, i.e. hydrocarbons having a molecular weight of $C_3$ or greater are avoided. In particular, highly reactive type species such as $C_3$ plus olefins are unsuitable for lift gas. Thus, lift gas streams comprising steam and light hydrocarbons are generally used.

The most readily available source for lift gas is from the gas concentration section of an FCC unit's product separation facilities. Taking lift gas from the gas concentration section places additional demands upon these facilities. Since the lift gas passes from the riser through the reactor and back to the gas concentration section, it is essentially a recycle stream. The additional throughput associated with the lift gas reduces the overall gas processing capabilities of the gas concentration facilities. Therefore, obtaining lift gas from the gas concentration section increases the cost of providing and maintaining the gas concentration section and where the gas concentration capacity limits the throughput through the FCC unit, the use of lift gas may be precluded or may reduce the amount of fresh feed processed in the FCC.

Further improvements in reduction of product losses and the control of regeneration temperatures have been achieved by providing multiple stages of catalyst stripping and raising the temperature at which the catalyst particles are stripped of products and other combustible compounds. Both of these methods will increase the amount of low molecular weight products that are stripped from the catalyst and will reduce the quantity of combustible material in the regenerator. A variety of arrangements are known for providing multiple stages of stripping and heating the spent catalyst to raise the temperature of the stripping zone. With increasing frequency it is being proposed to raise the temperature of the stripping zone by mixing the spent catalyst with hot regenerated catalyst from the regeneration zone.

DISCLOSURE STATEMENT

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 4,624,772, issued to Krambeck et al. on Nov. 25, 1986, discloses a closed coupled cyclone system that has vent openings, for relieving pressure surges, that are covered with weighted flapper doors so that the openings are substantially closed during normal operation.

U.S. Pat. No. 4,234,411, issued to Thompson on Nov. 18, 1980, discloses a reactor riser disengagement vessel and stripper that receives two independent streams of catalyst from a regeneration zone.

U.S. Pat. No. 4,479,870, issued to Hammershaimb et al. on Jun. 30, 1984, teaches the use of lift gas having a specific composition in a riser zone at a specific set of flowing conditions with the subsequent introduction of the hydrocarbon feed into the flowing catalyst and lift gas stream.

U.S. Pat. No. 4,464,250, issued to Maiers et al. and U.S. Pat. No. 4,789,458, issued to Haddad et al. teach the heating of spent catalyst particles to increase the removal of hydrocarbons, hydrogen and/or carbon from the surface of spent catalyst particles by heating the catalyst particles after initial stripping of hydrocarbons in the stripping zone of an FCC unit.

U.S. Pat. No. 4,789,458, issued to Haddad et. al. discloses the use of a second stage of stripping in a second stripping zone located subadjacent to a regeneration zone for the removal of hydrogen, hydrocarbons, and sulfur compounds from FCC catalyst before it passes into the regeneration zone.

BRIEF DESCRIPTION OF THE INVENTION

It is an object of this invention to provide a stripping and regeneration section that obtains essentially complete coke removal at relatively low regeneration temperatures.

It is another object of this invention to minimize or eliminate the recycle of lift gas through the gas concentration section of an FCC unit.

It is a further object of this invention to provide a direct source of lift gas from the reactor-regeneration section of an FCC unit.

This invention is a process that uses an FCC stripping zone to provide vapors that are suitable as lift gas for a riser reaction zone and to allow the low temperature operation of a regeneration zone. An appropriate off gas stream that can serve as a lift gas stream is made available by selecting a particular arrangement of catalyst stripping facilities. A preliminary or first stage of stripping that typically takes place in an FCC reactor will allow the reactor vessel to isolate a majority of the hydrocarbon products from a reactor disengagement vessel. Such a reaction zone can be used in combination with a subsequent and isolated stage of stripping and the stripping stream and stripped vapors from the subsequent stage can be used as a lift gas stream. These stripping gases make excellent lift gas sources since they already contain a high concentration of steam—the typical lift gas is approximately half steam. The hydrocarbon make-up of the stripped gases also facilitates their use as a lift gas source since long exposure to the catalyst at high temperatures has cracked essentially all of the hydrocarbon components to light gases. The subsequent stage of stripping operates at a higher pressure than the pressure in the lift gas zone so that the stripping gas will not require any compression to be used as lift gas. Recovery of the relatively high pressure stream of light stripping gas provides an elegant method of supplying lift gas. The amount of steam and light gas material entering the main column and gas concentration section of the FCC unit is directly reduced by the amount of such vapors that are used as lift gas. Thus, this invention provides an overall reduction in the size and operating costs of the gas concentration section for an FCC unit.

Aside from having benefits for the supply of lift gas, the subsequent stage of stripping can advantageously be used in combination with a low temperature regeneration operation. The additional stage of stripping when operated at a relatively high temperature provides a stripped catalyst stream that has essentially all low molecular weight combustible material removed therefrom. Therefore, the amount of fuel entering the regeneration zone in the form of hydrogen and relatively light hydrocarbons is essentially eliminated so that the total heat value of the stripped catalyst entering the regeneration zone is at least 40 percent less than the heat value of catalyst that normally enters the regeneration zone from less complete stripping operations. With the lower heat value of the catalyst, a single-stage regeneration zone can provide regenerated catalyst having a nearly complete removal of coke at a temperature below 1350° F. The relatively low regenerator temperature prevents catalyst deactivation which in turn allows the use of additional stages of stripping on the catalyst that leaves the regeneration zone. Stripping of the catalyst that is withdrawn from the regeneration zone keeps non-condensable gases that interfere with the operation of the wet gas compressor out of the stripping zone and the reactor riser when the regenerated catalyst is transferred thereto.

Accordingly in one embodiment, this invention is a process for the fluidized catalytic cracking of hydrocarbons. In this process hot regenerated catalyst particles are contacted with lift gas in an FCC feed in an upstream end of a riser conversion zone at hydrocarbon conversion conditions that include a first pressure. An effluent mixture of hydrocarbon vapors, steam and spent catalyst particles is passed from a downstream end of the riser conversion zone to a fluid solid separator. The spent catalyst particles are separated from hydrocarbon vapors and contacted with a stripping fluid in a stripping zone to remove additional hydrocarbon compounds from the spent catalyst particles. The separated hydrocarbon vapors and stripping fluid are withdrawn from the process. The separated catalyst particles are passed to a second stripping zone. The catalyst particles are contacted in the second stripping zone with a stripping fluid to displace adsorbed material comprising hydrocarbons from the surface of the catalyst particles to provide stripped catalyst particles. A gaseous mixture of the sorbed material and stripping fluid is collected from the second stripping zone. The second stripping zone operates at a pressure that is greater than the pressure in the upstream portion of the riser. Stripped catalyst particles are passed to a regeneration zone and contacted with a regeneration gas to remove carbonaceous deposits from the surface of the catalyst particles and to generate hot regenerated catalyst particles. At least a portion of the hot regenerated catalyst particles are passed to the riser and at least a portion of the gaseous mixture is passed to the riser to supply lift gas thereto.

In another embodiment, this invention is a process for the fluidized catalytic cracking of hydrocarbons in a riser-type conversion zone. The regenerated catalyst is contacted in an upstream portion of the riser with a lift gas comprising hydrocarbons and steam. Hydrocarbons in the lift gas comprise $C_3$ and lower molecular weight hydrocarbons. The regenerated catalyst and lift gas mixture contact an FCC feedstock in the riser at a location downstream of the lift gas and catalyst contacting. An effluent mixture comprising lift gas, hydrocarbons and spent catalyst is discharged from the downstream end of the riser into a reactor vessel. The effluent mixture from the riser is separated from the catalyst and withdrawn from the reactor vessel. Spent catalyst is passed downwardly from the reactor vessel into a stripping vessel and countercurrently contacted therein with a stream of stripping steam to remove adsorbed hydrocarbons from the surface of the catalyst. Steam and hydrocarbons desorbed from the surface of the catalyst pass upwardly into the reactor vessel and are removed with the effluent stream. Spent catalyst particles are withdrawn from the bottom of the stripper vessel and passed downwardly in dense phase transport to the bottom of the first stripper vessel to a second stripper vessel. Spent catalyst is contacted in the second stripper vessel with stripping fluid at a temperature of from 1000°-1200° F. for an average time of from 30 seconds to 2 minutes to provide stripped catalyst particles. A gaseous mixture of desorbed material from the second stripping vessel is collected and passed to the riser to supply at least a portion of the lift gas stream. Stripped catalyst particles are passed to a regeneration zone and contacted with a regeneration gas at a temperature of from 1250°-1350° F. to remove carbonaceous deposits from the surface of the catalyst particles and generate hot regenerated catalyst particles. At least a portion of the hot regenerated catalyst particles are passed to the riser. Another portion of the hot regenerated catalyst particles are withdrawn from the regeneration zone, contacted with a stripping gas in a third stripping vessel and passed to the second stripping zone to supply heat thereto.

Other objects, embodiments and details of this invention can be found in the following detailed description of the invention.

DETAILED DESCRIPTION OF THE INVENTION

Figure 1:
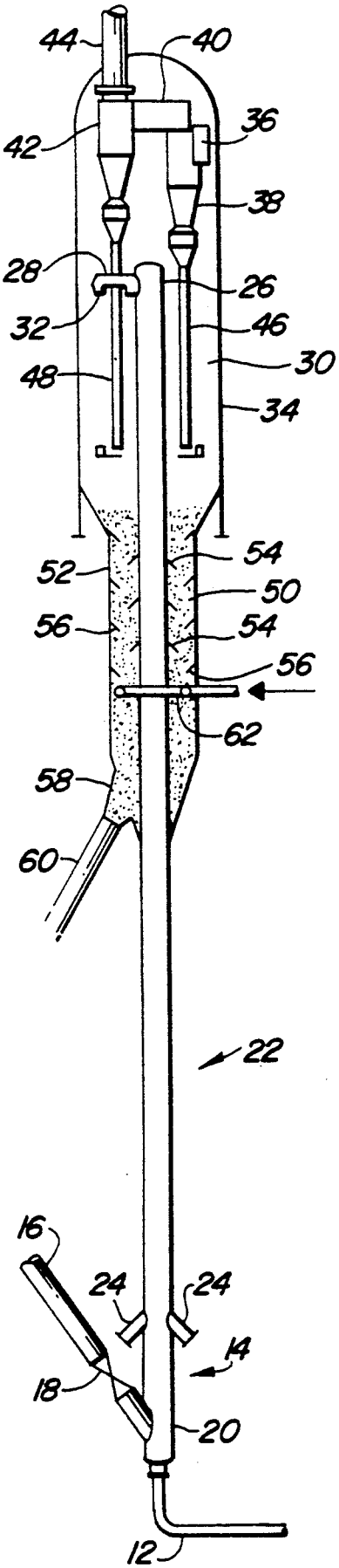
FIG. 1 is a sectional elevation of a typical FCC reactor riser reactor vessel and stripping zone.

The process and apparatus of this invention will be described with references to the drawings. Reference to the specific configurations shown in the drawings is not meant to limit the process of this invention to the particular details of the drawing disclosed in conjunction therewith.

Looking first at FIG. 1 and the operation of the riser conversion zone, a lift gas stream enters an inlet conduit 12 that passes the lift gas into the lower portion of a riser 14. Hot catalyst from a regenerated standpipe 16 passes through a control valve 18 and is mixed with the lift gas in a junction between the standpipe and lower riser generally referred to as a Y-section and denoted as 20 on the Figure. Lift gas carries the catalyst up the riser from lower section 14 to upper riser section 22 and conditions the catalyst by contact therewith. Between the upper and lower riser section, feed nozzles 24 inject hydrocarbon feed into the flowing stream of catalyst and lift gas. Hydrocarbon feed is converted as it travels to the end 26 of the riser. At the end 26, the riser terminates with an abrupt change of direction that directs the mixture of converted feed components and catalyst into transfer conduit 28.

The catalyst which enters the riser and can be used in the process of this invention include those known to the art as fluidizing catalytic cracking catalysts. These compositions include amorphous clay type catalysts which have for the most part been replaced by high activity crystalline alumina silicate or zeolite containing catalysts. Zeolite catalysts are preferred over amorphous type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, aluminum, or zirconium. These catalyst compositions may have a zeolite content of 30% or more.

Feeds suitable for processing by this invention, include conventional FCC feedstocks or higher boiling hydrocarbon feeds. The most common of the conventional feedstocks is a vacuum gas oil which is typically a hydrocarbon material having a boiling range of from 650°-1025° F. and is prepared by vacuum fractionation of atmospheric residue. Such fractions are generally low in coke precursors and heavy metals which can deactivate the catalyst.

This invention is also useful for processing heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the riser.

The finely divided regenerated catalyst entering the bottom of a reactor riser leaves the regeneration zone at a temperature usually in the range of 1200°-1400° F. Where the riser is arranged vertically, the bottom section will be the most upstream portion of the riser. In most cases, the riser will have a vertical arrangement, wherein lift gas and catalyst enter the bottom of the riser and converted feed and catalyst leave the top of the riser. Nevertheless, this invention can be applied to any configuration of riser including curved and inclined risers. The only limitation in the riser design is that it provide a substantially smooth flow path over its length.

Contact of the hot catalyst with the lift gas accelerates the catalyst up the riser in a uniform flow regime that will reduce backmixing at the point of feed addition. Reducing backmixing is important because it varies the residence time of hydrocarbons in the riser. Addition of the lift gas at a velocity of at least 3 feet per second is necessary to achieve a satisfactory acceleration of the catalyst. The lift gas used in this invention is more effective when it comprises $C_3$ and lower molecular weight hydrocarbons and particularly when it includes not more than 10 mol% of $C_3$ and heavier olefinic hydrocarbons. Low molecular weight hydrocarbons in the lift gas are believed to selectively passivate active metal contamination sites on the catalyst to reduce the hydrogen and coke production effects of these sites. Selectively passivating the sites associated with the metals on the catalyst leads to greater selectivity and lower coke and gas yield from a heavy hydrocarbon charge. Some steam may be included with the lift gas and, in addition to hydrocarbons, other reaction species may be present in the lift gas such as $H_2$, $H_2S$, $N_2$, CO, and/or $CO_2$. However, to achieve maximum effect from the lift gas, it is important that appropriate contact conditions are maintained in the lower portion of the riser. A residence time of 0.5 seconds or more is preferred in the lift gas section of the riser, however, where such residence time would unduly lengthen the riser, shorter residence times for the lift gas and catalyst may be used. A weight ratio of catalyst to hydrocarbon in the lift gas of more than 80 is also preferred.

After the catalyst is accelerated by the lift gas, it enters a downstream portion of the riser which is generally referred to as the upper section. Feed may be injected into the start of the section by nozzles as shown in the Drawing or any device that will provide a good distribution of feed over the entire cross-section of the riser. Atomization of the feed, as it enters the riser, promotes good distribution of the feed. A variety of distributor nozzles and devices are known for atomizing feed as it is introduced into the riser. Such nozzles or injectors may use homogenizing liquids or gas which are combined with the feed to facilitate atomization and dispersion. Steam or other non-reactive gases may also be added with the feed, for purposes of establishing a desired superficial velocity up the riser. The superficial velocity must be relatively high in order to produce an average residence time for the hydrocarbons in the riser of less than 5 seconds. Shorter residence times permit the use of higher reaction temperatures and provide additional benefits as discussed below; thus where possible the feed has a residence time of 2 seconds or less. In more limited embodiments of this invention, the residence time may be less than 1 second.

The catalyst and feed mixture has an average temperature in a range of from 850°-1050° F. A combination of a short residence time and higher temperatures in the riser shifts the process towards primary reactions. These reactions favor the production of gasoline and tend to reduce the production of coke and light gases. Furthermore, a higher temperature raises gasoline octane. A short catalyst residence time within the riser is also important for maintaining the shift towards primary reactions and removing the hydrocarbons from the presence of the catalyst before secondary reactions that favor coke and light gas production have time to occur.

The high velocity stream of catalyst and hydrocarbons is then rapidly separated at the end of the riser. This can be accomplished by passing directly into a cyclonic separation system or the riser can be configured so as to abruptly change direction before this initial separation. The separated vapors begin their path toward the product recovery zone while the separated catalyst is directed toward the stripping zone.

FIG. 1 shows an arrangement where transfer conduit 28 directs the product vapor and spent catalyst downwardly into a disengaging zone 30 through an opening 32. The disengaging zone is defined by a reactor vessel 34. Directing the catalyst and product vapor downwardly into the disengaging zone 30 promotes separation of catalyst from the vapors. It is also possible to direct the catalyst from the riser directly into a cyclone or tangentially into a chamber to initiate separation of catalyst from the vapors. Product vapors that are disengaged from the catalyst rise upwardly to the inlet 36 of a primary cyclone 38. The product vapors and a residual amount of catalyst are carried from primary cyclone 38 through a transfer duct 40 to a secondary cyclone 42 which removes residual amounts of fine catalyst particles from the product vapors before they are withdrawn from the vapor through an outlet line 44. A pair of dip legs 46, 48 return fine catalyst particles separated by cyclones 38 and 42 to a lower portion of the disengaging zone 30. Catalyst disengaged by outlet 32 and catalyst recovered from cyclones 38 and 42 fall downward into a stripping section or zone 50 that is defined by a stripping vessel 52. Product vapors from conduit 44 are carried overhead to the main column of the FCC separation facilities. Product vapor entering the main column may still have a small concentration of solid particles which are removed by solid separation equipment within the FCC separation section.

The catalyst particles passing out of disengaging zone 30 enter the top of stripping zone 50. Stripping zone 50 is arranged principally vertically and has a number of vertically spaced baffles 54 that extend outwardly and downward from the riser 22 and are offset from a series of baffles 56 that extend inwardly and downwardly from the outer wall of stripper vessel 52. Catalyst is withdrawn from the bottom of stripping zone 50 through an outlet 58 into a spent catalyst conduit 60 that transfers spent catalyst to a hereinafter described regeneration zone. As catalyst is withdrawn from the bottom of the stripper, baffles 54 and 56 cascade the catalyst from side to side. The movement of the catalyst increases contact between the catalyst and stripping fluid, in this case steam, that enters the bottom of the stripping zone 50 through a distributor ring 62. The stripping fluid is added to stripping zone 34 below the lowermost grid 56. After the stripping fluid contacts the catalyst, it becomes mixed with hydrocarbon vapors that have been stripped from the catalyst. Stripping gas, in its usual form of steam, is added to the stripping vessel in an amount equaling 0.5 to 2 wt.% of the feed charged to the riser.

In the stripping zone as shown in FIG. 1, the stripping zone operates at about the same temperature as that of the catalyst and product leaving the riser. At these temperatures contact of the catalyst with the stripping fluid will remove readily strippable hydrocarbons from the catalyst surface. As gas and vapors continue to rise in the stripper countercurrently to the flow of catalyst, the concentration of hydrocarbons in the stripping fluid increases. At the end of the stripping zone 50, a small portion of the stripping fluid will flow into disengaging zone 30 where it eventually enters the cyclone inlet 36 with the rest of the product vapors from the riser.

Spent catalyst taken from stripping zone 50 by spent catalyst conduit 60 is passed to a stripping vessel 62 (shown in FIG. 2) at a rate regulated by a control valve 64. Stripping vessel 62 houses a stripping zone 64 wherein the spent catalyst is mixed with a stripping fluid and hot regenerated catalyst particles. The stripping fluid enters stripping zone 64 through a distributor 66. Again, in most cases, the stripping fluid will comprise steam. Hot catalyst is carried by a transfer conduit 68 from a regeneration zone 70 at a rate regulated by a control valve 72. Mixing of the hot catalyst, spent catalyst and stripping fluid in zone 64 provides what is known as a hot stripping section. Stripping chamber 64 is operated to maintain a dense bed of catalyst 65 in a lower region thereof.

Figure 2:
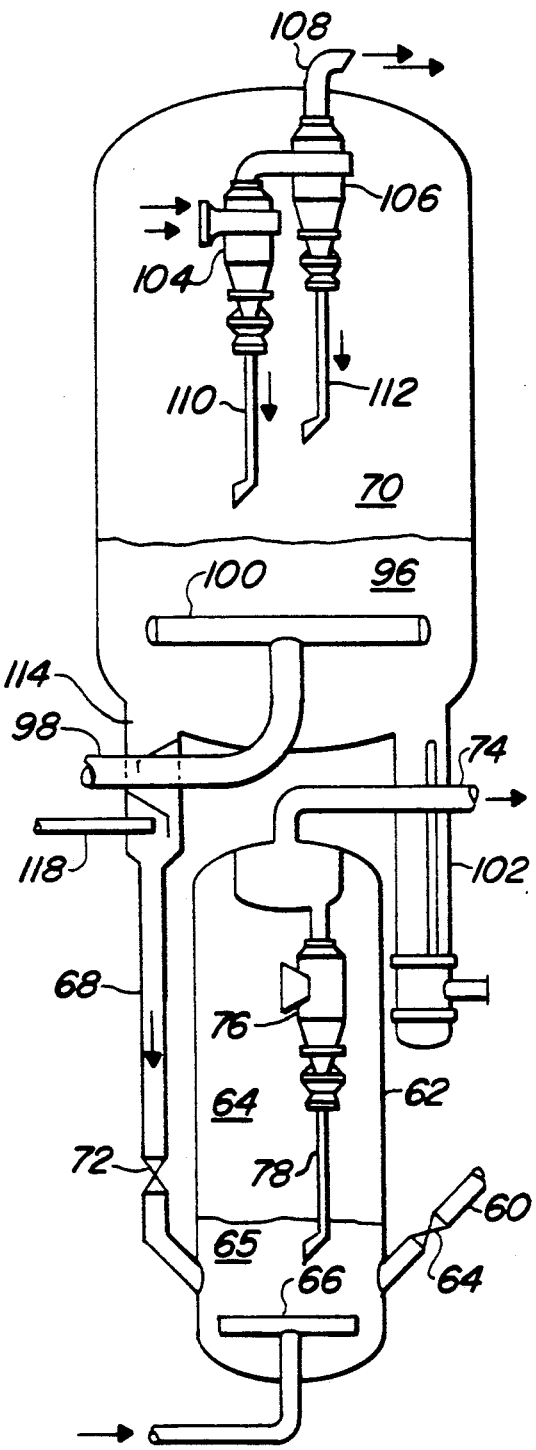
FIGS. 2 and 3 are elevation views of a single stripping and regeneration zone arranged in accordance with this invention.

Hot catalyst stripping refers generally to the operation of a catalyst stripper at a temperature above the usual reactor temperature. In normal operation, this means that the stripper will have a temperature above at least 975° F. Greater advantages are obtained when the stripper is maintained above 1050° F. Although FIG. 2 shows an embodiment of the invention wherein the temperature of the stripping zone is raised by the admixture of hot catalyst therewith, the temperature in the stripping section may be raised by a variety of other methods. Such other methods include heating coils and the introduction of hot regenerated catalyst into the stripping zone. The combination of the first stripping zone 50 provided below the reactor disengaging zone 30 and the second zone of stripping 64 has the advantage of providing a first stripping section that removes less highly adsorbed hydrocarbon components from the catalyst surface before they are overcracked and still have substantial product value. Passing catalyst from the first stripping zone to the second stripping zone allows further hydrocarbons, hydrogen and strippable coke compounds to be removed from the catalyst surface. By this arrangement, the secondary hot stripping removes combustible material that if left on the catalyst would interfere with the regeneration process by increasing the amount of combustible material that enters the regeneration zone and the heat released during the regeneration process. The high temperature stripping operation leaves mainly graphitic coke on the catalyst surface. Hydrogen in the coke can be reduced by as much as 4 or 5 wt. % with the use of a hot stripping zone. Therefore, much of the coke, after the hot stripping, is graphitic in form.

The gas stream, removed from the secondary zone, consists primarily of stripping fluid, highly cracked hydrocarbons and hydrogen. Because of the higher temperatures and longer duration of catalyst contact, the gas removed from a hot stripping zone has a very low molecular weight and is highly suitable for use as lift gas. Typically, the gaseous mixture withdrawn from the second stripping zone will contain, on a water-free basis, between 30-70% light paraffinic hydrocarbons.

The second or hot stripping zone of this invention is designed to maximize the removal of combustible material from the entering spent catalyst. Conditions within the stripping zone will typically include a temperature of from 1000°-1200° F. Higher temperatures are preferred to maximize the removal of strippable compounds. Contact time within the stripping zone will vary from 30 seconds to about 2 minutes. A relatively long stripping time is preferred in order to maximize the removal of strippable compounds. Average residence times of less than 30 seconds in the second stripping zone may be used when the heat value of the spent catalyst entering the stripping zone is not high. Although longer average residence times than 2 minutes may be used, it is not believed that such longer duration will offer substantial advantages or improvements.

The gaseous mixture of stripping fluid and light gases are removed from the top of stripping zone 64 by a conduit 74. At least a portion of these gases taken by conduit 74 are returned to the reactor riser through conduit 12, shown in FIG. 1, in order to supply at least a portion of the lift gas used in the riser. Any of the gaseous mixture withdrawn by conduit 74 that is not used as lift gas can be recovered and treated for other uses such as fuel gas. Of course, portions of the gaseous mixture that are not used as lift gas can also be passed to the main column or gas concentration section of the FCC.

Figure 3:
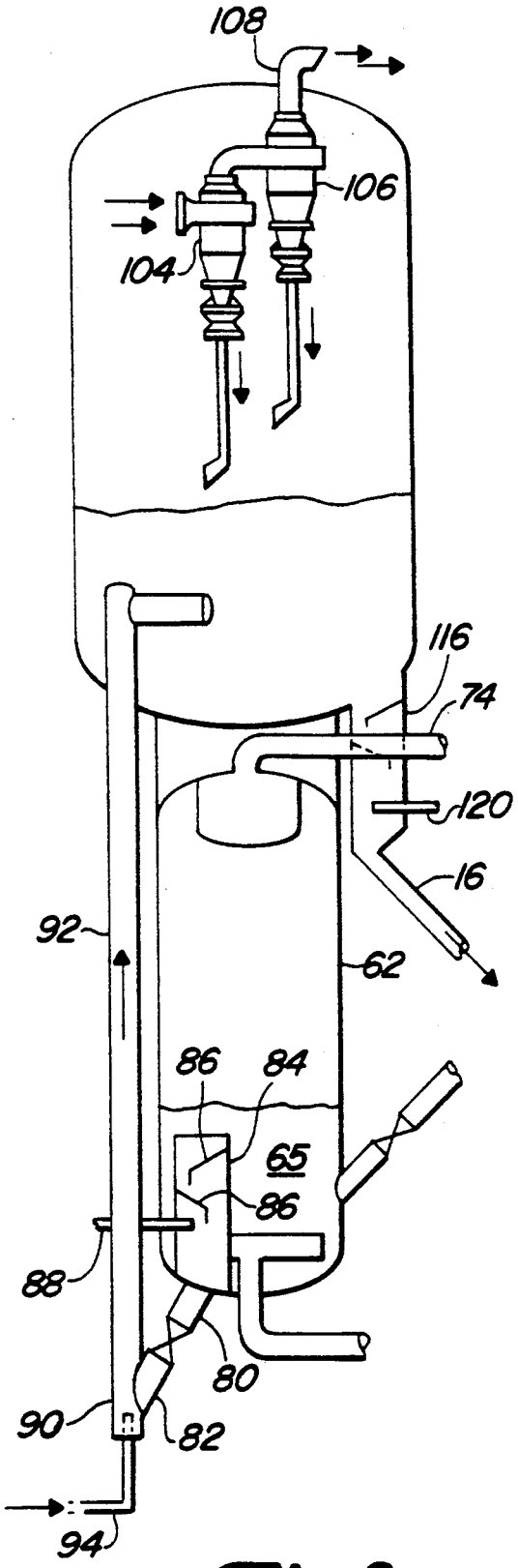

The second stripping zone operates at a higher pressure than the reactor vessel, the riser, and the first stripping zone. A higher pressure in the second stripping zone permits the direct transfer of the gaseous mixture from the second stripping zone to the reactor riser as lift gas. A pressure differential of about 6 psi will usually be needed to directly transfer the gaseous mixture from the second stripping zone to the riser. In the embodiment of FIGS. 1-3 a pressure differential is maintained between the two stripping zones by the dense catalyst head in conduit 60 and the control valve 64. The use of a lower location for the second stripping zone is only one method of obtaining the necessary pressure differential and this invention may be practiced by using any other arrangement that will provide the second stripping zone with a sufficiently higher pressure than the riser.

An optional cyclone 76 is shown in stripping zone 64. The cyclone 76 is used to remove fine catalyst particles from the exiting gaseous mixture which are returned to the stripping zone by dip leg conduit 78. The use of cyclones 76 is unnecessary when most of the gaseous mixture 74 is used as lift gas—the addition of fine catalyst particles with the lift gas in the riser will not pose any problems in its operation. Where a substantial amount of the gaseous mixture from conduit 74 is passed to the product recovery section of the FCC unit or other gas treating facilities, cyclone 76 is used to reduce the catalyst loading to these facilities.

The stripped catalyst from stripping zone 64 is removed by a stripped catalyst conduit 80 that withdraws the stripped catalyst particles from the bottom of stripping vessel 62. The arrangement of the stripped catalyst conduit is shown in FIG. 3, which has been provided to clarify the details of the regenerator arrangement. All of the equipment shown in FIGS. 2 and 3 are provided for a stripping vessel and regeneration zone that correspond to a particular embodiment of this invention. The withdrawal of catalyst particles from stripping zone 64 is regulated by a control valve 82. An optional stripping chamber 84 having internal stripping baffles 86 and 88 can be provided as shown in FIG. 3. Additional stripping fluid in the form of steam is provided, by a conduit 88, below the lowermost grid 86. Stripping chamber 84 has a smaller total volume than stripping zone 64 and can be located within stripping chamber 64 or externally to stripping chamber 64 with catalyst being transferred thereto. The purpose of stripping chamber 84 is to provide relatively high ratio of stripping fluid to catalyst in a small volume zone to eliminate essentially all of the carryover of light hydrocarbon and hydrogen gases from the stripping zone 64 into regeneration zone 70. FIG. 3 shows the stripping chamber 84 located within stripping zone 64 with the upper lever of the chamber below the top of catalyst bed 65 so that catalyst will flow therein.

As the catalyst leaves control valve 82, it passes into a Y section 90 where it is contacted with air from a conduit 94 to transport it upwardly through a riser 92 and into the bottom of regeneration zone 70. The essential purpose of riser 92 is to provide an air lift into regeneration zone 70. Catalyst can be transferred up riser 92 in relatively dense phase or dilute phase conditions. Initial contact of the catalyst with the air in riser 92 will initiate combustion of coke from the catalyst. Therefore, the riser 92 can be operated under relatively dilute phase conditions to provide a preliminary fast fluidized zone of catalyst regeneration before the catalyst and air enter the regeneration zone 70.

Regeneration zone 70 is operated with a dense phase region 96 in the form of a bubbling bed. Compressed air from line 98 is distributed through a distributor 100 over the cross-section of the upper regenerator. Air from distributor 100 will be added at a rate that will maintain the dense bed 96. In most cases sufficient air will be present in the regeneration zone to obtain complete regeneration of the catalyst by the removal of coke deposits to a concentration of less than 0.1 wt. % on the catalyst particles. Because of the reduced amount of combustible material that now enters the regeneration zone with the stripped catalyst, a dense bed temperature of between 1250°-1300° F. may be maintained in dense bed 96. For relatively light FCC feeds, dense bed 96 can be maintained in this temperature range while still performing a complete combustion of CO to $CO_2$. Lower regeneration temperatures are generally preferred in regeneration zone 70 for a number of reasons. Lower regeneration temperatures prevent deactivation of the catalyst and improve the control of metals on the catalyst. Lower regenerator temperatures also facilitate the use of $SO_x$ acceptor compounds in the catalyst—$SO_x$ acceptors are usually more effective at lower temperatures. For example, the hot stripping zone used in combination with a lower temperature regenerator zone and a $SO_x$ acceptor can reduce sulfur in coke from 1 to 0.1 wt. %.

In order to control temperatures when processing relatively heavy FCC feedstocks or when lower temperatures are desired, FIG. 2 shows the addition of a backmix type catalyst cooler 102 in communication with dense bed 96. Any number or type of catalyst coolers may be used to control or adjust the temperature of dense bed 96. The design of backmix coolers and other types of catalyst coolers are well known in the prior art. Although FIG. 3 shows the use of a catalyst cooler to cool the dense bed 96, any form of heat removal device may be used to control or adjust the temperature of dense bed 96. Any type of cooler arrangement can be used including flowthrough coolers where catalyst is withdrawn from the cooler and transferred to another section of the reactor or regenerator arrangement.

The by-products of the coke combustion that consist primarily of $CO_2$ are separated from any entrained catalyst that is carried upward through the dilute phase region of regeneration zone 70 by a primary cyclone 104 and secondary cyclone 106. The separated gases are withdrawn overhead by a conduit 108 and separated catalyst is returned to dense bed 96 through dip legs 110 and 112. Regenerated catalyst is withdrawn from the dense bed 96 for transfer to the hot stripping zone and reactor riser 14 as previously described.

As catalyst is withdrawn for transfer to either the riser or hot stripping zone, it may be contacted with additional stripping fluid in order to remove any non-condensible gases that become entrained with the catalyst. FIG. 2 shows a short contact time stripper 114 for the transfer conduit 68 and FIG. 3 shows a short contact time stripper 116 for the regenerated standpipe 16. The non-condensible gases that are removed by the use of the short contact time strippers 114 and 116 consist primarily of $CO_2$, nitrogen and oxygen that is present in the regeneration zone. Stripping fluid is provided by conduits 118 and 120 to short contact time strippers 114 and 116, respectively. Steam is again used as the preferred stripping fluid. The average contact time for the catalyst particles in the short contact strippers is less than 5 seconds. A low temperature operation of the regeneration zone allows the steam to be added to the stripping zone without causing substantial catalyst deactivation. Any steam deactivation that might occur from the use of short contact time strippers 114 and 116 can be minimized by operating the dense bed 96 at a relatively low temperature such as 1250° F.

The above description and drawings describe particular embodiments of this invention. The description and drawings are not meant to limit the scope of this invention to the particular embodiment shown therein.

I claim:

1. A process for the fluidized catalytic cracking (FCC) of hydrocarbons said process comprising:

a) contacting hot regenerated catalyst particles, lift gas and an FCC feed in an upstream end of a riser conversion zone at hydrocarbon conversion conditions;

b) passing an effluent mixture of hydrocarbon vapors, steam and spent catalyst particles from a downstream end of said riser conversion zone to a fluid solid separator, contacting said spent catalyst particles with a stripping fluid in a first stripping zone at a first pressure to remove hydrocarbon compounds from said spent catalyst particles, separating hydrocarbon vapors and steam from said spent catalyst particles, withdrawing the separated hydrocarbon vapors and stripping fluid from said process and passing the separated catalyst particles to a second stripping zone;

c) contacting catalyst particles at a second pressure in said second stripping zone with a stripping fluid to displace adsorbed material comprising hydrocarbons from the surface of said particles to provide stripped catalyst particles and collecting a gaseous mixture of desorbed material and stripping fluid, wherein said second pressure is greater than said first pressure;

d) passing said stripped catalyst particles to a regeneration zone and contacting said particles with a regeneration gas to combust coke and remove carbonaceous deposits from the surface of said catalyst particles and generate hot regenerated catalyst particles and passing at least a portion of said hot regenerated catalyst particles to said riser; and.

e) passing at least a portion of said gaseous mixture to said riser to supply at least a portion of said lift gas stream.

2. The process of claim 1 wherein said effluent mixture passes in closed communication from said riser conversion zone to a cyclone separator and essentially all of said hydrocarbon vapors and steam are withdrawn from the process by said cyclone separator.

3. The process of claim 2 wherein said gaseous mixture has a temperature of about 850°-1250° F.

4. The process of claim 1 wherein hot regenerated catalyst particles are mixed with the spent catalyst particles in said second stripping zone and said gaseous mixture comprises hydrogen, steam and light hydrocarbons.

5. The process of claim 4 wherein said gaseous mixture has a temperature in a range of from 950°-1250° F.

6. The process of claim 1 wherein said gaseous mixture is passes through a separation device for the removal of fine catalyst particles before it is passed to said riser.

7. The process of claim 1 wherein said spent catalyst has an average residence time of from 30 sec. to 2 min. in said second stripping zone.

8. The process of claim 4 wherein said hot regenerated catalyst particles are stripped with steam in a third stripping zone prior to entering said second stripping zone.

9. The process of claim 1 wherein said regeneration zone operates at a temperature of between 1250° and 1350° F.

10. The process of claim 1 wherein said stripped catalyst is withdrawn from said second stripping zone through a stripping chamber, said stripping chamber having a smaller volume than said second stripping zone, and said stripped catalyst is contacted with a stripping fluid in said second stripping zone.

11. The process of claim 1 wherein said regeneration zone is operated at a temperature of less than 1300° F.

12. The process of claim 1 wherein said spent catalyst particles pass downwardly in dense phase transport from said first stripping zone to said second stripping zone.

13. A process for the fluidized catalytic cracking (FCC) of hydrocarbons in a riser conversion zone said process comprising:

a) contacting regenerated catalyst in an upstream portion of said riser conversion zone with a lift gas comprising hydrocarbons and steam, said hydrocarbons in said lift gas comprising $C_3$ and lower molecular weight hydrocarbons, and contacting a regenerated catalyst and lift gas mixture with an FCC feedstock in said riser conversion zone at a location downstream of the lift gas and catalyst contacting;

b) discharging an effluent mixture comprising lift gas, hydrocarbons and spent catalyst from a downstream end of said riser conversion zone into a reactor vessel;

c) separating spent catalyst from said effluent mixture and withdrawing said effluent mixture from said reactor vessel;

d) passing said spent catalyst downwardly from said reactor vessel into a first stripper vessel, countercurrently contacting said spent catalyst with a stream of stripping steam to remove adsorbed hydrocarbons from the surface of said catalyst, withdrawing spent catalyst from the bottom of said stripper vessel and passing steam and hydrocarbons desorbed from the surface of said catalyst upwardly into said reactor vessel;

e) passing said spent catalyst downwardly in dense phase transport from the bottom of said first stripper vessel to a second stripper vessel and contacting said spent catalyst with a stripping fluid at a temperature of from 1000° F. to 1200° F. for a an average time of from 30 sec. to 2 min. to provide stripped catalyst particles and collecting a gaseous mixture of desorbed material and stripping fluid;

f) passing said stripped catalyst particles to a regeneration zone and contacting said particles with a regeneration gas at a temperature of from 1250° to 1350° F. to combust coke and remove carbonaceous deposits from the surface of said catalyst particles and generate hot regenerated catalyst particles;

f) withdrawing hot regenerated catalyst particles from said regeneration zone and passing at least a portion of said hot regenerated catalyst particles to said riser;

h) withdrawing hot regenerated catalyst particles from said regeneration zone, contacting said hot regenerated catalyst particles with a stripping gas in a third stripping vessel and passing said stripped hot regenerated catalyst particles to said second stripping zone; and, i) passing at least a portion of said gaseous mixture to said riser to supply at least a portion of said lift gas stream.

14. The process of claim 13 wherein said regenerator operates at a temperature of less than 1300° F.

* * * * *